United States Patent [19]

Schmidt

[11] Patent Number: 4,589,610

[45] Date of Patent: May 20, 1986

[54] GUIDED MISSILE SUBSYSTEM

[75] Inventor: Donald J. Schmidt, Ellicott City, Md.

[73] Assignee: Westinghouse Electric Corp., Pittsburgh, Pa.

[21] Appl. No.: 549,861

[22] Filed: Nov. 8, 1983

[51] Int. Cl.[4] ..... F41G 7/22

[52] U.S. Cl. ..... 244/3.19; 343/5 CM

[58] Field of Search ..... 244/3.19, 3.15; 343/5 CM

[56] References Cited

U.S. PATENT DOCUMENTS

| | | | |
|---|---|---|---|
| 3,603,992 | 9/1971 | Goggins, Jr. et al. | 343/5 CM |
| 3,976,998 | 8/1976 | Voles et al. | 343/5 CM |
| 4,021,801 | 5/1977 | Chernick | 244/3.19 |
| 4,132,989 | 1/1979 | Arens | 343/5 CM |
| 4,134,113 | 1/1979 | Powell | 343/5 CM |
| 4,136,343 | 1/1979 | Heffner et al. | 244/3.19 |
| 4,204,210 | 5/1980 | Hose | 343/5 CM |
| 4,227,194 | 10/1980 | Herman et al. | 343/5 CM |
| 4,246,580 | 1/1981 | Caputi, Jr. | 343/5 CM |
| 4,387,373 | 6/1983 | Longuemare, Jr. | 343/5 CM |

*Primary Examiner*—Charles T. Jordan
*Attorney, Agent, or Firm*—W. E. Zitelli

[57] ABSTRACT

A guided missile subsystem including a Kalmanized radar track loop driven by acceleration signals of the missile generated by an inertial measuring unit (IMU), and a missile control loop driven by estimates of the relative kinematics of the missile and target computed by the radar track loop is disclosed. The IMU driven Kalmanized radar track loop accommodates the use of a high performance radar, like a synthetic aperture radar, for example, which operates to measure radar data at a low rate on the order of 1 Hz, to generate estimates of relative target and missile kinematics to drive the control loop at rates compatible with high performance missile kinematics. The Kalmanized track loop effects an exchange of IMU errors for "dynamic lag" errors of conventional track loops which cannot be modeled very well, and can change very rapidly. In contrast, the IMU errors can be modeled well, and in addition change very slowly which is what permits the Kalmanization function to work well in the track loop at reduced rates. Because of the dynamic exactness of the track loop, very good estimates of the relative kinematics of the missile may be supplied to the control loop to effect more accurate computations of maneuver commands which drive the controls of the missile. Moreover, the Kalmanized track loop does not let large amounts of angle glint noise into the control loop prior to missile impact. An effective bandwidth decrease as glint noise increases is provided without incurring a dynamic lag error penalty.

16 Claims, 11 Drawing Figures

$$\frac{\dot{X}_{UD} + \dot{X}_{LR}}{R} \triangleq \text{LOS ANGLE RATE}, \alpha$$

GUIDED MISSILE SUBSYSTEM

BACKGROUND OF THE INVENTION

The present invention is related to guided missiles, fin general, and more specifically, to a guided missile subsystem including a Kalmanized radar track loop driven by acceleration signals generated by an inertial measuring unit, and a missile control loop driven by estimates of the relative kinematics of the missile and target computed by the radar track loop.

Missiles which are launched from aircraft in air-to-surface and air-to-air weapon delivery scenarios often include a guidance subsystem which operates to guide the missile on a collision course to a target. In some cases, the missile is launched after having acquired a target, wherein a search radar onboard the launch aircraft may initialize the guidance subsystem of the missile with the identified target cooridinates. In other cases, the missile may be launched prior to identifying a particular target, wherein the launch aircraft's radar may initialize the missile guidance subsystem to a patch on the ground or a target location estimated a priori. In this case, the missile guidance subsystem may identify and close in on a target within the specified ground patch or a priori target location.

In one embodiment, the missile guidance subsystem may include a self-contained radar on board the missile and may operate autonomously in an active mode. In other embodiments, the missile guidance subsystem may include only a radar seeker which operates in a semiactive mode; that is, the radar on the launch aircraft tracks and illuminates a particular target while the seeker in the missile picks up the back scatter from the launch aircraft radar, locks on and tracks the target back scatter until collision. In either embodiment, there exists no data link between the missile and the launch aircraft. Independent of whether the missile is operated in an active or semiactive mode, the guidance subsystem generally includes a radar processor and associated track loop or loops which provide feedback techniques to improve the accuracy of the missile guidance.

Generally, the radar tracking function is implemented with three partitioned track loops—a range track loop, a simple clutter or range rate track loop, and an angle track loop. The angle track loop may operate in conjunction with the radar processor to maintain the radar antenna boresight on identified target location. The range and range rate track loops may include integrators to provide an estimated range measurement and estimated range rate measurement for radar processing, respectively. In turn, the radar processor may compute the difference between corresponding actual and estimated range and range rate measurement and drive the corresponding integrator of the track loops directly with the appropriate computed difference. Because the tracking function does not fully take into account all of the real world kinematics of the missile motion, the model provided by the track loops may not be kinematically or dynamically exact. Accordingly, the range and range rate estimations generated thereby may produce errors in the missile guidance, commonly referred to as "dynamic lag errors".

The dynamic lag errors of the tracking loops may become quite large and troublesome especially when there exists a relative acceleration between the missile and the target. Generally, the way of coping with these large dynamic lag errors is to override them by cranking up the data rate measurement production of the radar processor. The data rate production of the radar processor may also have to be increased because of the inability of the conventional track loops to distinguish between angular and translational motion of the missile. To accomodate the missile guidance model imposed by the conventional track loops, the associated radar processor may be required to produce measurements at a relatively high data rate, say on the order of 30 Hz, for example.

These high data rate measurement constraints on the radar processor mey render insufficient time for processing the raw data received from the radar front end. Accuracy of the data measurements may be degraded because of the lack of time for adequate noise and clutter rejection. Moreover, with regard to synthetic aperture radar processors, insufficient processing time may result in incomplete motion compensation and nulling which results in a ground image generation of poor resolution. This poor image resolution may lead to greater miss distances of the missile with the target. Thus, it is of paramount importance to improve the modeling of the missile guidance dynamics in the tracking loops of the missile guidance system to permit a lowering of the measurement data rate of the associated radar processor and effect an improvement in radar measurement accuracy.

Another drawback of a conventional missile guidance subsystem is its sensitivity to the phenomenon known as angle glint, especially at short ranges, wherein the radar track loop which is fixed in frequency bandwidth becomes progressively less stable as the missile approaches the target. Consequently, the adverse effect of angle glint on the missile guidance is inversely proportional to the range of the target. Since angle glint is one of the chief contributors to target miss distances, ameliorating the phenomenon will lead to a reduction of the target miss distances.

SUMMARY OF THE INVENTION

A missile guidance subsystem is disposed on-board a missile and operative during the flight of the missile to cooperate in guiding the missile to the location of a target. The missile guidance subsystem comprises: a radar including an antenna system, front end, and a signal processor. The antenna system is governed by beam steering commands to maintain the beam pattern of the radar antenna on the target location. The front end is operative to receive radar echo signals within the beam pattern and to condition the radar echo signals for processing by the signal processor. In addition, the signal processor is operative to derive true radar measurements of the missile kinematics in relation to the target kinematics from the conditioned radar echo signals.

In accordance with the present invention, the missile guidance subsystem further comprises: control means governed by a set of maneuver commands to control the missile kinematics; an inertial measuring unit for generating signals corresponding to the acceleration of the guided missile in accordance with predetermined spacial coordinates; means for integrating the acceleration signals of the inertial measuring unit to generate estimates of the relative kinematics of the missile and target in accordance with the spacial coordinates; means for converting the estimates of the relative kinematics into a priori estimates of radar measurements of the missile and target relative kinematics, and into beam steering commands for the radar antenna system, the signal processor being operative to compute signals representative of the differences between corresponding estimated and true radar measurements; filtering means for deriving error signals based on an estimating function of the computed radar measurement difference signals, the error signals derived in accordance with the spacial coordinates for correcting corresponding intermediate relative kinematics estimates of the integrating means to render the relative kinematic estimates; and means for generating the set of maneuver commands based on a control malfunction of the relative kinematics estimates.

The integrating means, converting means, radar and filtering means constitute, in combination, a radar tracking loop governed by the acceleration signals generated by the inertial measuring unit. In one embodiment, the filtering means may include a Kalman filter portion for generating estimates of tracking loop errors based on optimal filter techniques using a priori information of error processes of the tracking loop. The Kalman filter portion may include a set of Kalman gain vectors for operating on the radar measurement difference signals for generating the tracking loop error estimates. In some embodiments, the Kalman filter portion may extract from the radar measurement difference signals an index of filter performance for use in adjusting the Kalman gain vectors used in the error estimation process to compensate for errors in modeling target accelerations.

Another aspect of the present invention is directed to the conditions in which the acceleration signals are generated by the inertial measuring unit at a first rate and the measurement difference signals are generated by the radar signal processor at a second rate, substantially slower than the first rate. In addition, the filtering means is operative to derive the error signals at a rate commensurate with the second rate. Under these conditions, the integrating means is operative to accommodate the acceleration signals at the first rate and the error signals at the slower rate to generate the relative kinematics estimates at a rate commensurate with the first rate.

A further aspect of the present invention is directed to navigational update filtering means for deriving error signals based on an estimating function of the radar-measured kinematics difference signals to compensate for errors in the acceleration signals generated by the inertial measuring unit.

DESCRIPTION OF THE PREFERRED EMBODIMENT

Figure 1:
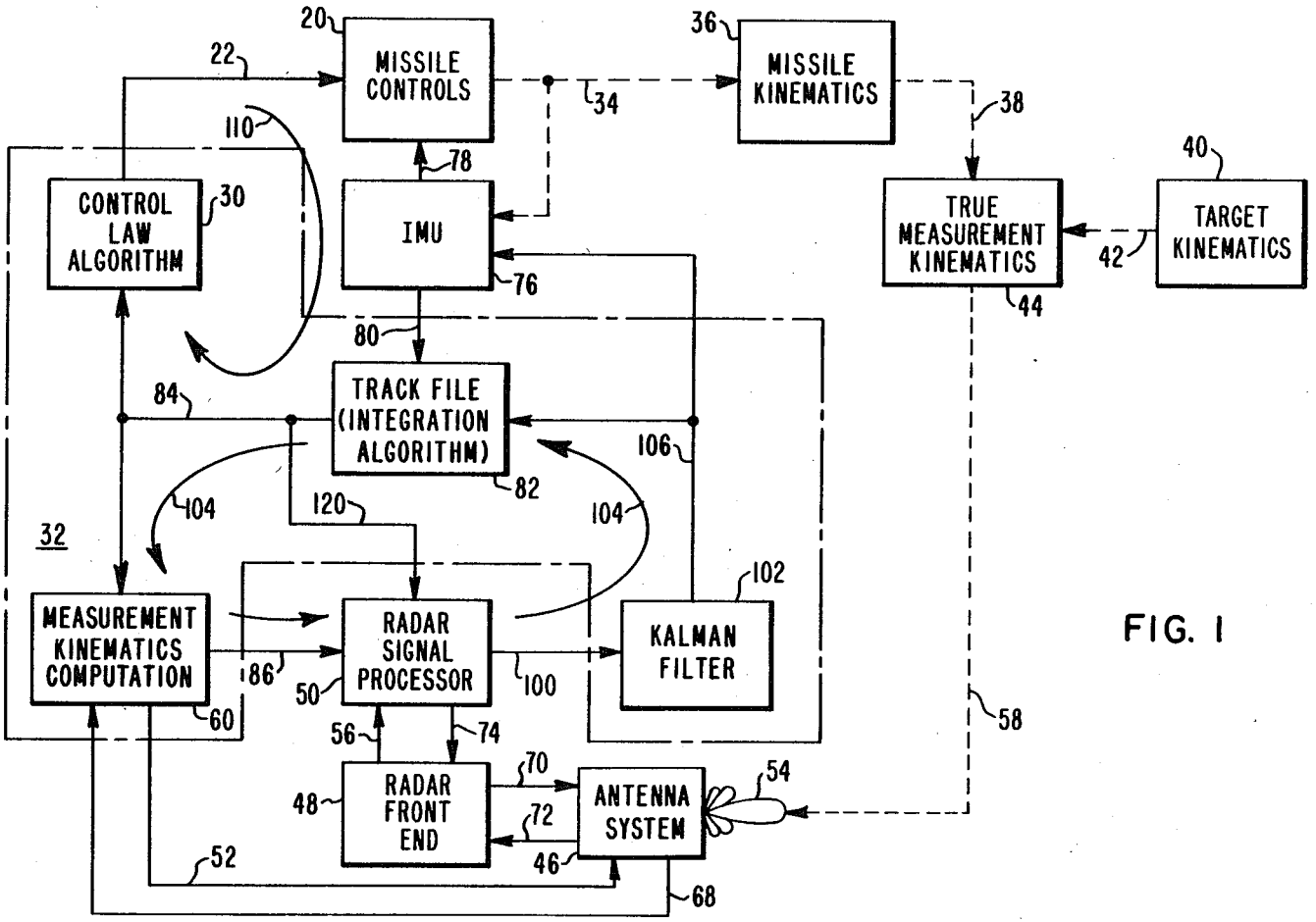
FIG. 1 depicts a functional block diagram schematic of a missile guidance subsystem suitable for embodying the principles of the present invention.
Figure 2:
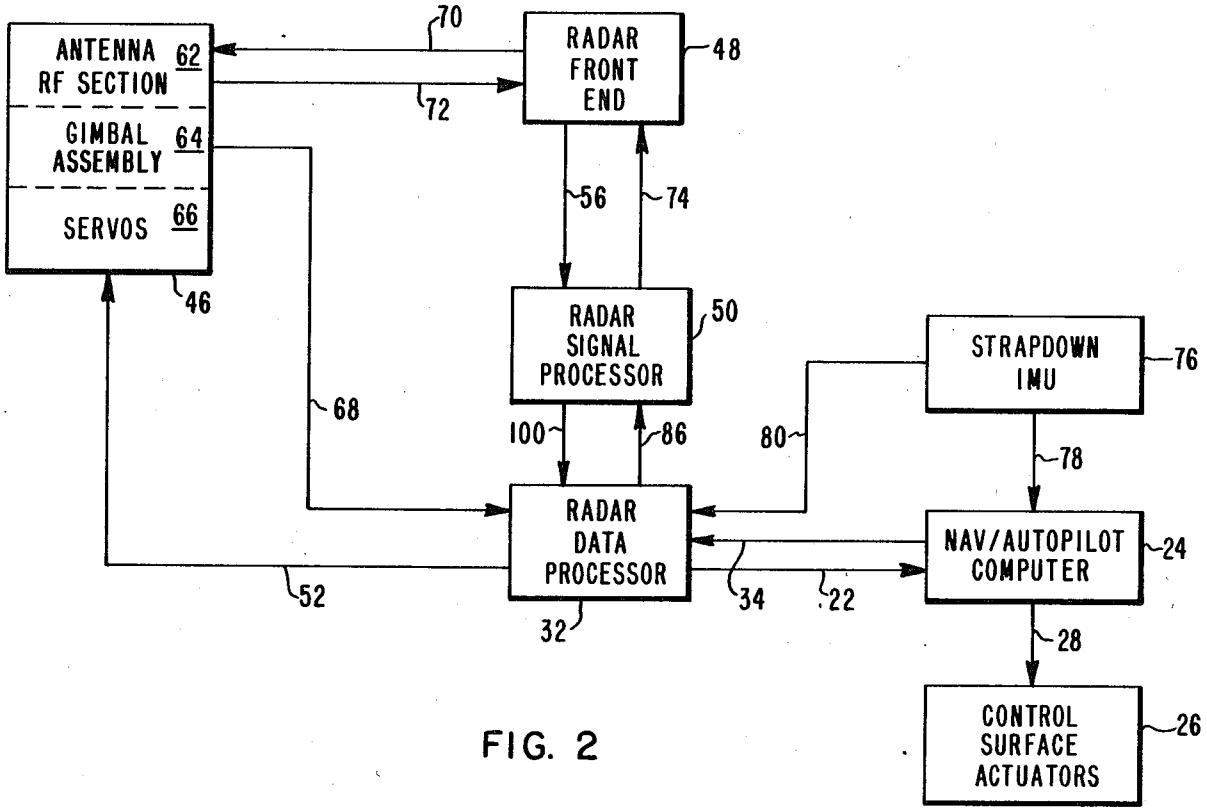
FIG. 2 is a block diagram schematic of typical hardware interfaces suitable for implementing the functions of the embodiment of FIG. 1.

FIG. 1 depicts a functional block diagram schematic of a missile guidance subsystem suitable for embodying the principles of the present invention; and FIG. 2 is a block diagram schematic of typical hardware interfaces suitable for implementing the functions of the embodiment of FIG. 1. The missile guidance subsystem may be disposed on-board a missile and be operative during the flight of the missile to guide the missile to the location of a target. Conventional missile controls 20 is governed by a set of maneuver commands 22 to control the missile kinematics. As shown in FIG. 2, the missile controls 20 may be implemented by a conventional navigation-/auto pilot computer 24 operating in cooperation with control surface actuators 26 of the missile. The auto pilot computer 24 may generate torque commands 28 to govern the surface actuators 26 to guide the missile on a desired flight path. A control law algorithm, shown by the block 30 in FIG. 1, may be programmed in a radar data processor 32 (FIG. 2) and used to produce the maneuver commands 22 provided to the auto pilot computer 24.

That portion of FIG. 1 which is depicted by the dashed lines is illustrative of the physical kinematics of the missile and target. For example, the missile controls 20 effect a true acceleration on the missile which is illustrated by the dashed line 34. This effected true acceleration alters the missile kinematics depicted by the block 36 to produce true position and velocity responses depicted by the dashed line 38. The target kinematics is depicted by the block 40 effecting a true position and velocity thereof depicted by the dashed line 42. A radar disposed on the missile as part of the guidance subsystem thereof is capable of measuring the missile kinematics in relation to the target kinematics which is illustrated by the block 44.

In general, the radar includes an antenna system 46, a radar front end 48 and a radar signal processor 50. The antenna system 46 may be goverened by beam steering commands 52 to maintain a beam pattern 54 generated thereby on a specific target location. The radar front end 48 may include a conventional radar receiver for receiving radar echo signals within the beam pattern 54 and for conditioning the radar echo signals for processing by the signal processor 50. The radar signal processor 50 may derive from the conditioned echo information 56 applied thereto from the front end 48 true radar measurements of the missile kinematics in relation to the target kinematics, a physical illustration thereof depicted by the dashed line 58.

In the present embodiment, the beam steering commands 52 include beam pointing angle errors computed from a measurement kinematics computation algorithm 60 which may be programmed in the radar data processor 32. The antenna system 46 conventionally includes an antenna and associated RF section 62 which may be positioned by a conventional gimbal assembly 64 generally in azimuth and elevation directions. Corresponding conventional servomechanisms 66 may be used to drive the gimbal assemblies 64 to their desired positions as governed by the computed pointing errors in azimuth and elevation supplied thereto over signal lines 52. For this particular embodiment, gimbal displacement angles representative of the azimuth and elevation pointing angles of the antenna system 46 may be fed back to the radar data processor 32 over signal lines 68 for use by the programmed computational algorithm 60. This data path may not be present if the antenna beam is steered electronically.

In some embodiments, the radar front end 48 may include a transmitter for providing transmitting signals 70 to the antenna system 46 which in turn effects a transmitting beam 54 in a direction towards the location of the target. In the receive mode, the antenna system 46 may receive radar echo signals within the beam 54 and supply the RF return signals 72 to a radar receiver disposed in the front end 48. The transmitter control data may be supplied to the front end 48 from the radar signal processor 50 over signal lines 74. In other embodiments, the front end 48 may include only a radar seeker for receiving echo signals from the target location which are the back scatter of transmitted signals from a transmitter positioned elsewhere, like on the missile launching aircraft, for example. Either embodiment may be suitable for embodying the principals of the present invention.

Figure 3:
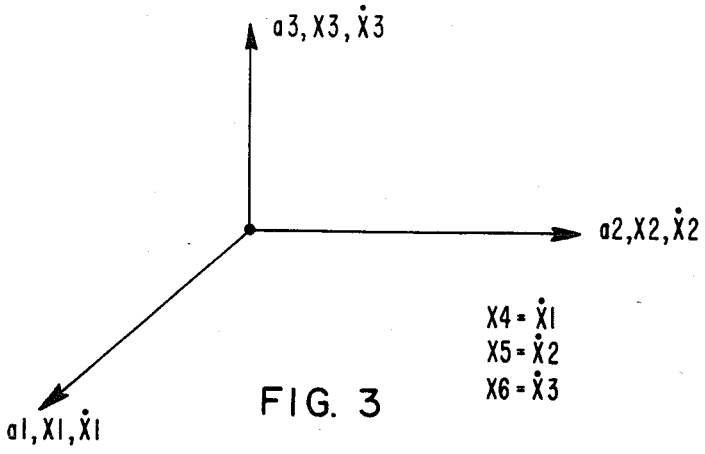
FIG. 3 exemplifies an orthogonal three axis coordinate system suitable for use as a frame of reference in the embodiment of the missile guidance subsystem of FIG. 1.

In accordance with one aspect of the present invention, an inertial measuring unit (IMU) 76 may be disposed on-board the missile for measuring the true ownship acceleration of the missile kinematics. The missile ownship acceleration may be measured in the IMU 76 along predetermined spatial coordinates like that shown by the coordinate system in FIG. 3 which depicts an orthogonal three axis coordinate system in which the accelerations a1, a2, and a3 are measured along the orthogonal coordinates thereof. In one case, the measured acceleration signals may be supplied to the missile controls 20 for feedback purposes over signal lines 78. In the embodiment, the IMU 76 may be an independent multi-sensor unit similar to the type manufactured by Singer-Kearfoot which utilizes accelerometers and associated conventional gyro controls for measuring acceleration and angle rate about two axes simultaneously to affect the desired acceleration measurement outputs. Other embodiments may combine the IMU 76 and auto pilot computer 24 in one unit. One integrated packages of this type is manufactured by Honeywell Aerospace Division and is part of a unit commonly referred to as ATIGS, Advanced Tactical Inertial Guidance System. A similar integrated package is manufactured by Lear-Seigler Instrument Division and is part of a unit commonly referred to as LCIGS, Low Cost Inertial Guidance System.

The missile acceleration measurement signals may also be provided to the radar data processor 32 over signal lines 80 for use in a track file integration algorithm 82 which may be programmed in the processor 32. In the present embodiment, the integration algorithm 82 is governed by the missile acceleration signals 80 of the IMU 76 to generate estimates 84 of the relative kinematics of the missile and target in accordance with the predetermined spatial coordinates. Included in the estimated relative kinematics 84 may be a set of relative position and velocity estimates of the missile and target. Referring to the coordinate system of FIG. 3, the signals $\dot{X}1$, $\dot{X}2$, and $\dot{X}3$ are representative of the estimated relative position vectors along the respective predetermined coordinate axes. Likewise, the notations X1, X2, and X3 are representative of the estimated relative velocity vectors corresponding to the three axes of the orthogonal system. For state-space computational purposes the estimated relative velocity vectors may also be respectively denoted as X4, X5, and X6.

The estimated relative position and velocity estimates 84 may be provided to the control law algorithm 30 of the radar computer processor 32 for use therein in generating the maneuver commands 22. The operation of the control law algorithm 30 will be described in greater detail herebelow. In addition, the relative position and velocity estimates 84 may be provided to the measurement kinematics computation algorithm 60 of the radar computer 32 also for use therein. The computational algorithm 60 is operative to convert the estimated relative position and velocity 84 into estimated radar measurements 86 of the missile kinematics in relation to the target kinematics, and into beam steering commands 52 for the radar antenna system 46.

Figure 4:
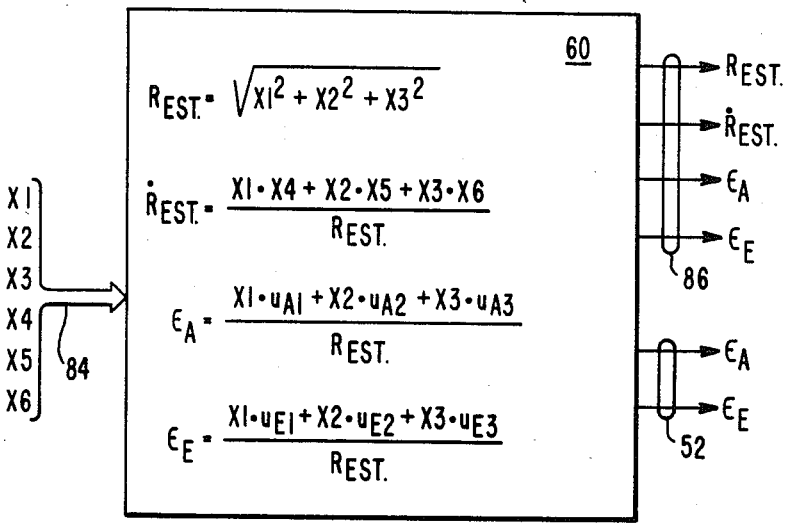
FIG. 4 depicts a functional block and exemplary conversion processes for use therein to convert relative kinematics estimates into estimated radar measurements suitable for use in the embodiment of FIG. 1.

Included in the estimated radar measurements may be the estimated range, the estimated range rate, the estimated antenna beam azimuth pointing angle error and the estimated antenna beam elevation pointing angle error, denoted by $R_{EST}$., $\dot{R}_{EST}$., $\epsilon_A$ and $\epsilon_E$, respectively. Typical equations for the conversion process of the relative position and velocity estimates X1 through X6 are shown in the block 60 of FIG. 4. In the computation of the antenna beam pointing angle errors $\epsilon_A$ and $\epsilon_E$ for azimuth and elevation, respectively, unit vectors $U_{Ai}$ and $U_{Ei}$, for i=1,3, pertain to the azimuth and elevation directions of the antenna reference axes. The estimated range $R_{EST}$, range rate $\dot{R}_{EST}$, antenna azimuth beam pointing angle error $\epsilon_A$ and the estimated elevation antenna beam pointing angle error $\epsilon_E$ signals may be provided to the signal processor over signal lines 86. The estimated range $\dot{R}_{EST}$ and estimated range rate $R_{EST}$ are used therein to set the range gates and doppler filter banks necessary for radar signal processing.

Concretely, a doppler filter bank is an array of spectral components of a radar video signal, stored in a corresponding array of digital computer memory addresses. A commonly used technique for generating the spectral components of a signal, not the only technique, is the Fast Fourier Transform. The estimated antenna beam pointing angle errors $\epsilon_A$ and $\epsilon_E$, are used in the signal processor 50 to compensate the measurements of the beam pointing angle errors for errors in the response of the antenna beam steering controls to steering commands. If the antenna beam steering controls are electromechanical, as they would be if the antenna were gimballed, the estimated antenna beam pointing angle errors $\epsilon_A$ and $\epsilon_E$ are sent to the antenna system 46 over signal lines 52, wherein they are used as error signals in the antenna steering servo. If the antenna beam steering controls are electronic phase-shifters, the unit line-of-sight vector, the components of which are $X_1/R_{EST}$, $X_2/R_{EST}$ and $X_3/R_{EST}$, is sent to the antenna system 46 over signal lines 52, wherein it is used to command the phase-shifters.

Figure 5:
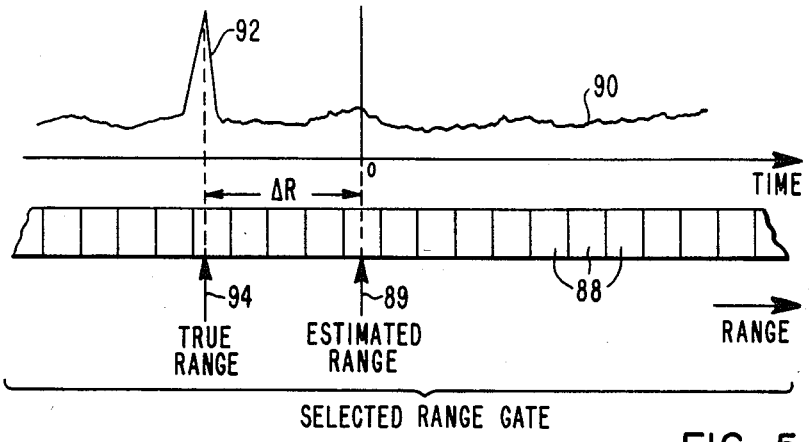
FIGS. 5 and 6 are illustrations depicting the operations of setting the range gates and doppler filter banks, respectively, with corresponding estimated radar measurements in a conventional radar signal processor.
Figure 6:
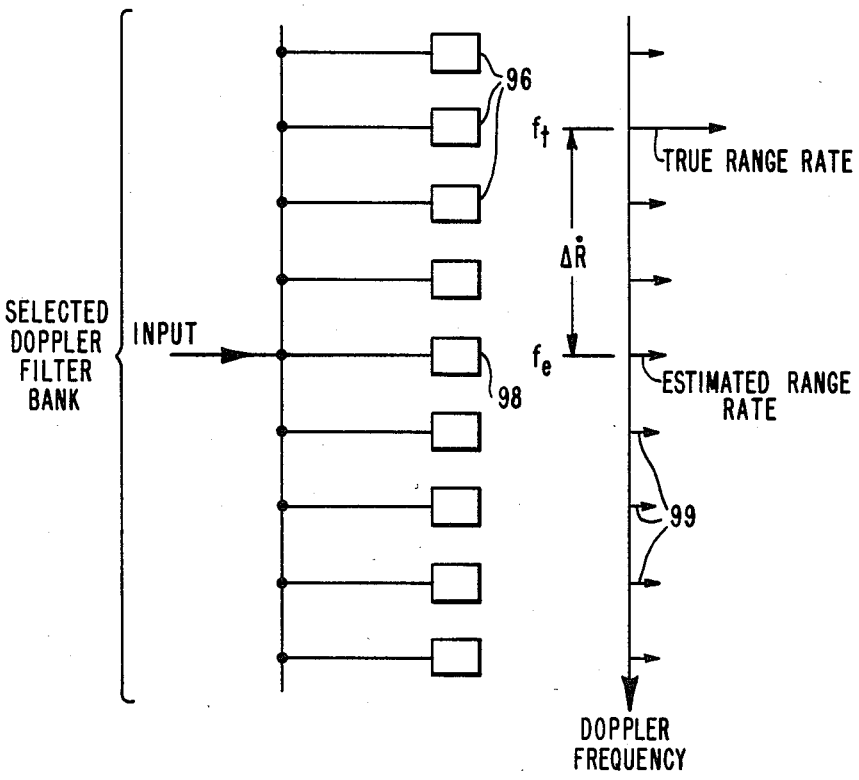

The setting of the range gates and doppler filter banks is illustrated in FIGS. 5 and 6, respectively. In general, the reception time of a radar is divided into a succession of radar range cells denoted by the blocks 88 in FIG. 5. The radar signal processor 50 may select a range gate or group of cells surrounding the estimated range measurement denoted by the arrow 89. The radar processor 50 may then concentrate on only those selected range cells 88 within the selected range gate to determine the true range. The smaller the range cells within the selected range gate, the lower the noise the radar processor has to contend with and accordingly the better the signal to noise ratio. A typical analog radar echo signal is shown by the waveform 90 in FIG. 5. Note that the reception time and range cell divisions are registered. The peak 92 in the time waveform 90 may be indicative of a traget with a true range denoted by the arrow 94. The radar processor 50 may compute a signal representative of the measurement difference, denoted as $\Delta R$, between the estimated and true range measurements.

Similarly, in the doppler filter processing of the radar processor 50 as shown by the illustration of FIG. 6, the information from selected common range cells collected over a plurality of reception times becomes the input to the doppler filters 96 of the processor 50. The estimated range rate measurement may be represented by a doppler frequency output of one of the doppler filters 98 and denoted as $f_e$ in the doppler frequency spectrum. Accordingly, a bank of doppler filters may be selected about the doppler filter 98 for establishing the true range rate measurement. This, of course, reduces the amount of doppler filter processing which must occur by limiting the number of doppler filters in the doppler computational operation. The arrowed lines 99 on the doppler frequency spectrum are representative of the amplitude output of the doppler filters 96 in the selected bank. The true range rate measurement may be determined as the largest arrowed output and denoted as $f_t$. Thus, the differences between estimated and true doppler frequencies $f_e$ and $f_t$, respectively, is representative of the radar measurement difference of range rate denoted as $\Delta\dot{R}$.

The antenna beam pointing angle errors may be measured in the radar signal processor 50 from conditioned echo signals by monopulse techniques. They are small angle displacements about the azimuth and the elevation antenna reference axes. To perform measurements about both the azimuth and the elevation antenna reference axes, the beam can be split into quadrants. If the antenna is a reflector type, this can be done by splitting the feedhorn into quadrants. If the antenna is a phased-array type, it would be done by splitting the array into quadrants. A third technique, utilizing an unsplit antenna beam, entails scanning a single antenna beam through a quadrant pattern. Because returns are obtained in four antenna beam quadrants simultaneously with the split beam techniques, these techniques require eight parallel channels of data through the front end of the radar receiver and the radar signal processor:

1. Four beam quadrants
2. In-phase and quadrature signal components for each beam quadrant The scanning technique requires only two parallel channels of data through the front end of the radar receiver and the radar signal processor, since radar returns are received in only one beam quadrant at a time. That is, the scanning technique entails time-multiplexing in the data channels through the front end of the radar and the radar signal processor. Hence the scanning technique is widely known as "single channel monopulse". When using this terminology, the in-phase and quadrature signal component channels are thought of as a single data channel, this veiwpoint being appropriate because both components of a signal can be represented mathematically as a single complex number. The single-channel monopulse technique obviously requires a simpler, less costly mechanization, but the performance of the multichannel techniques is considerably better.

The extraction of antenna beam pointing angle error measurements from the radar signals is the same in all three monopulse techniques. The in-phase and quadrature components of four radar return signals appear in a particular range gate and in a particular doppler cell, one pair of components per antenna beam quadrant. The antenna beam pointing angle error measurement is extracted from these four signals by the following coherent operations:

1. Summing the returns in the two antenna quadrants on one side of the azimuth reference axis of the antenna.
2. Summing the returns in the two antenna quadrants on the other side of the azimuth reference axis of the antenna.
3. Subtracting the results of Steps 1 and 2.
4. Summing the returns in all four antenna quadrants.
5. Dividing the result of Step 3 by the result of Step 4.
6. Normalizing the result of Step 5.

Coherent signal processing operations are operations in which signal phase information is preserved. They can be represented mathematically as operations on complex numbers (one of Steinmetz's most useful discoveries). The antenna azimuth pointing angle error measurement is the magnitude of the complex number obtained in Step 6 above. The antenna elevation beam pointing angle error measurement is obtained by also doing these operations for the elevation reference axis of the antenna.

If there were no significant errors in the response of the antenna beam steering controls to steering commands, these antenna beam pointing angle error measurements would be suitable for use in track integrator error estimation, like in a Kalman filtering algorithm, for example. In practical cases, it never is possible to be sure of this. Hence it is necessary to compensate for antenna beam steering control response errors by subtracting the estimated antenna beam angle errors, generated in the measurement kinematics routine, from the measured beam steering angle errors. In what follows, the symbols $\Delta\epsilon_A$ and $\Delta\epsilon_E$ will be used to represent the difference between the measured and the estimated antenna beam steering angle errors in the azimuth and in the elevation channels, respectively.

The measurement processes described directly above may require pulsed coherent transmitter waveforms. That is because the transmitter signal is needed as a reference signal to set the range gates and the doppler filter banks. In the case of a semiactive missile, in which the transmitter is not on the missile, the reference signal may be obtained from a rear-looking antenna illuminated by the transmitted signal. Because of the one-way transmission path, the design of the rear-looking antenna is not critical. For example, beam steering fortunately is not necessary.

The radar range, range rate, azimuth antenna beam pointing angle error and elevation antenna beam pointing angle error measurement difference signals $\Delta R$, $\Delta \dot{R}$, $\Delta\epsilon_A$ and $\Delta\epsilon_E$, derived by the signal processor 50 may be provided over signal lines 100 to a filtering algorithm 102 which may be programmed in the radar data processor 32. The filtering algorithm 102, which is preferably a Kalman filering algorithm for the present embodiment, estimates track integrator errors from the computed radar measurement different signals 100. The error signals are derived in accordance with the predetermined spatial coordinates (refer to FIG. 3) for correcting corresponding intermediate measurement signals generated in the integration algorithm 82 to render the relative position and velocity estimates 84.

The integrating algorithm 82, the computational algorithm 60, the radar, and the Kalman filter algorithm 102 constitute, in combination, a radar tracking loop 104 governed by the missile acceleration signals 80 generated by the IMU 76. The Kalman filter algorithm 102 may generate estimates of position and velocity tracking loop errors for the three-axis orthogonal coordinate system (refer to FIG. 3) based on optimal filter techniques using a priori information of the error processes of the tracking loop 104. These error correction signals may be supplied to the tracking algorithm 82 utilizing functional lines 106.

In general, the Kalman filter algorithms conventionally model the real world and are initialized, integrated and updated at the same time as the radar measurements $\Delta R$ and $\Delta \dot{R}$ are performed. With a priori information, the Kalman filter algorithm 102 is operative to extract desired error statistics from the radar measurement stream 100 using optimal filter techniques. In a very simplified explanation, one portion of the Kalman filter algorithm 102 conventionally uses a matrix of gain vectors, denoted by [K], for operating on the radar measurement difference signals, [ΔZ], to generate the tracking loop error estimates [ΔX] in accordance with the following equation (refer to FIG. 7):

$$[\Delta X]_{NEW}=[\Delta X]_{OLD}+[K]\{[\Delta Z]-[H][\Delta X]_{OLD}\} \quad (1)$$

where $$[\Delta X] \triangleq \begin{bmatrix} \Delta X1 \\ \Delta X2 \\ \Delta X3 \\ \Delta X4 \\ \Delta X5 \\ \Delta X6 \\ \Delta X7 \\ \Delta X8 \\ \Delta X9 \end{bmatrix}$$

, which represents 9 state variable estimates -
3 positional errors $\Delta X1$, $\Delta X2$, $\Delta X3$;
3 velocity errors $\Delta X4$, $\Delta X5$, $\Delta X6$; and
3 target accelerations $\Delta X7$, $\Delta X8$, $\Delta X9$,

[K] ≜ Kalman gain vector matrix,

[H] ≜ observation vector matrix, linearized math model, and $[\Delta Z] \triangleq [\Delta R\ \Delta\dot{R}\ \Delta\epsilon_A\ \Delta\epsilon_E]$.

The state variables or error estimates [ΔX] may be generated at the same rate as the radar measurement difference signals [ΔZ] are generated.

Figure 7:
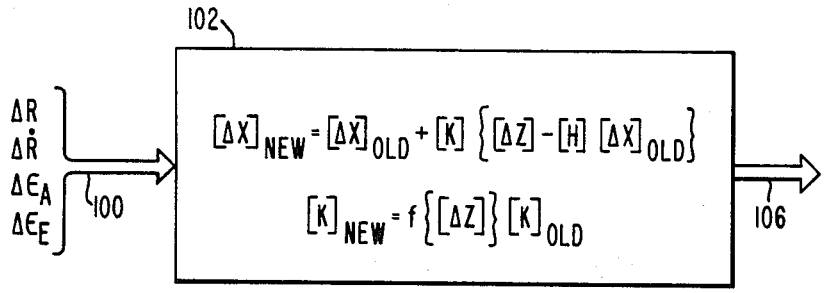
FIG. 7 depicts a functional block exemplifying the operations of a Kalman filtering algorithm suitable for use in the embodiment of FIG. 1.

In addition, another portion of the Kalman filter algorithm 102 may extract from the radar measurement difference signals [ΔZ] on index of filter performance f{[ΔZ]} for use in adjusting the Kalman gain vector matrix [K] used in the error estimation process of equation (1) above to compensate for errors in modeling the estimates of target accelerations ΔX7, ΔX8 and ΔX9 (refer to FIG. 7).

Figure 8:
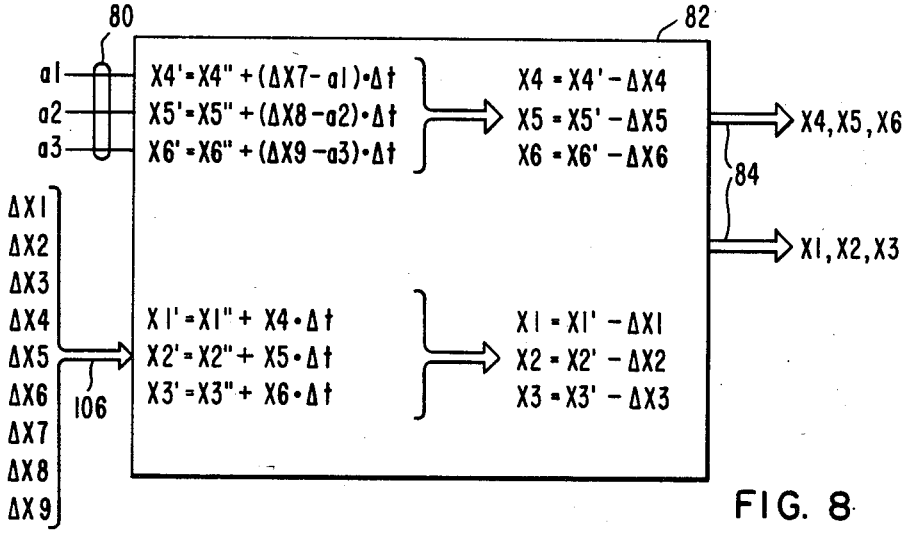
FIG. 8 depicts a functional block of exemplary operations of a track integration algorithm suitable for use in the embodiment of FIG. 1.

In general, the integration algorithm 82 is operated at a much higher rate than the Kalman filter algorithm 102 because the generated relative position and velocity data are used to derive the estimated range, range rate and antenna beam pointing angle errors to set the range gates and doppler filter banks in the radar signal processor 50 and position the radar beam via antenna system 46, respectively; and to provide guidance data to the missile controls 20, through the control law routine 30. Simplified equations of the integration algorithm 82 are shown in the block of FIG. 8. The integration equations may be recursive and sequential processes to generate the intermediate relative measurement positions prior to correction. The algorithm 82 is operated at time intervals Δt and accordingly, the acceleration signals a1, a2 and a3 may be sampled at the same rate for use therein.

Referring to FIG. 8, the first group of equations compute the intermediate relative velocity measurement estimate X'i, for i=4 to 6, using the corresponding acceleration signal ai, for i=1 to 3; the previous value of the relative velocity measurement signal X''i; and the target acceleration estimates ΔXi, for i=7 to 9. Thereafter, the intermediate relative velocity estimates are corrected using the presently available corresponding error correction signal ΔXi, for i=4 to 6, to render the relative velocity estimates X4, X5 and X6. In turn, the intermediate relative position estimates X'i, for i=1 to 3, are computed from the previously derived corresponding relative velocity estimates and the corresponding previous value of the relative position estimate X''i, for i=1 to 3. Thereafter, the intermediate relative position estimates X'i are corrected with the presently available corresponding position error correction signals ΔXi to render the relative position estimates X1, X2 and X3.

Note that the rate at which the error correction signals ΔX1 through ΔX9 are generated by the filtering algorithm 102 may be different than the rate at which the corresponding intermediate relative position and velocity estimates are generated in the integration algorithm 82. The correction portion of the integration algorithm 82 accommodates any difference in rates therebetween by correcting with the presently available corresponding error correction signal ΔXi. Thus, should the integration rate be high, say on the order of 256 Hz, for example, in generating the intermediate relative position and velocity estimates and the Kalman filter 102 be operative to generate error correction signals at a rate of only 1 Hz, for example, then the correction portion of the integration algorithm 82 will merely update the error correction signals used therein once every 256 corrections (i.e. using the same correction error signal for each successive 256 computations).

One advantage of the present configuration of the missile guidance subsystem as described in connection with the embodiment of FIGS. 1 and 2 is that the IMU 76 and track integration algorithm 82 in combination render the track loop dynamically exact, so that very good error models may be determined for use in the Kalman filter 102 which permits the Kalman filter error correction signal updates to work so well at reduced operational rates. In actuality, the instant embodiment is exchanging IMU errors for "dynamic lag" errors of conventional track loops which cannot be modeled very well, and can change very rapidly. In contrast, the IMU errors can be modeled well, i.e. there exists very good models for IMU errors, and in addition they change very slowly. Accordingly, this is what makes the Kalman filter error correction updating function work so well in the track loop 104 at reduced derivation rates.

Thus, the combination of the IMU 76, track integration algorithm 82 and Kalman filter algorithm 102 provide for a dynamically exact real world tracking model. In addition, since the Kalman filter algorithm is not required to provide for error correction signals at the same rate as that of the relative position and velocity estimate derivation by the integration algorithm 82, it does not impose a high operational rate on the radar signal processor to produce the measurement difference signals 100. This affords the radar processor 50 greater time for more sophisticated radar processing, like noise attenuation, background clutter suppression, . . . etc., i.e. to discriminate targets from other extraneous signals more accurately. Furthermore, the overall track loop 104 improves radar signal processor accuracy by providing for a more accurate setting of the range gates and positioning of the doppler filter banks, for example, which allows for smaller range gate and doppler filter cells, which improve noise and clutter rejection. Still further, the Kalman filter algorithm 102 inherently causes the track loop bandwidth to be progressively more narrow as the missile approaches the target without upsetting the accuracy thereof. This results in a suppression of the phenomenon known as angle glint at very short ranges.

With regard to another aspect of the present invention, the track integration algorithm 82, the control law algorithm 30, the missile controls 20 and the IMU 76, in combination, constitute a control loop 110 of the missile guidance subsystem. Within the control loop 110, the control law algorithm 30 is operative to generate a set of maneuver commands 22 according to an up-down and left-right coorindate axis system based on a control law function of the estimated relative position and velocity vector estimates 84 generated by the integrating algorithm 82. The maneuver commands 22 either can be normal acceleration commands or velocity vector turn rate commands, depending on the input requirements of the autopilot in the missile controls 20. Preferably, the control law function 30 is based on well-proven proportional navigation techniques. Nonetheless, it could be based on newer control laws derived from optimal control theory, at such time as the reliability of these is proven in an operational environment.

Figure 9:
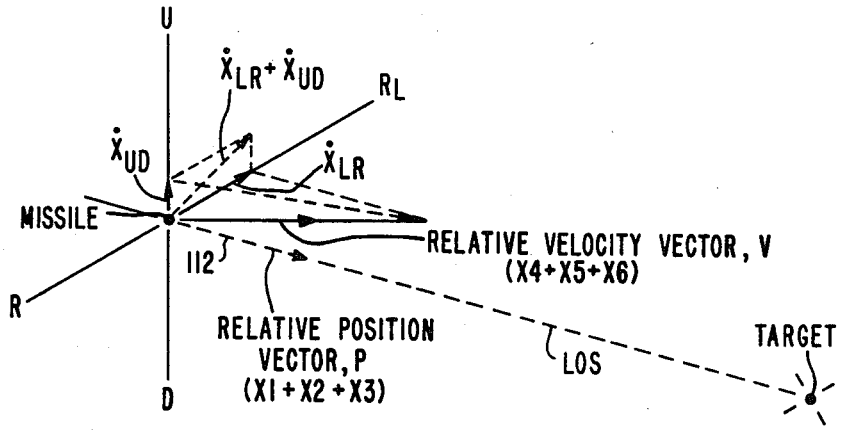
FIG. 9 is a sketch illustrating a control law function suitable for use in the embodiment of FIG. 1.
Figure 10:
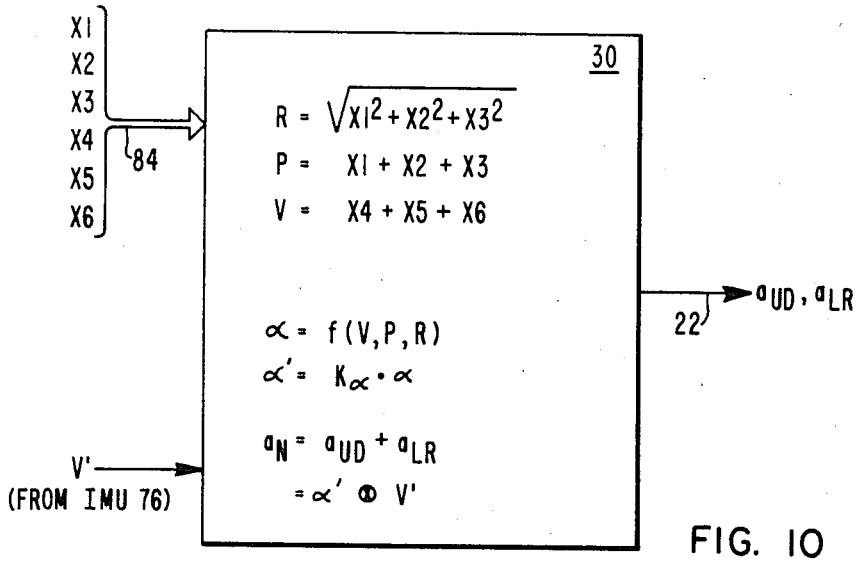
FIG. 10 depicts a functional block with simplified equations for performing the control law function illustrated in FIG. 9.

An illustration exemplifying a control law function is shown in the sketch of FIG. 9 with simplified equations thereof shown in the block 30 of FIG. 10. Generally, the control law function may transform the relative velocity vector V, comprised of the components X4, X5 and X6 of the 3-axis orthogonal system (FIG. 3), into a reference frame with one axis 112 aligned with the relative position vector P, which is comprised of the components X1, X2 and X3, i.e. line-of-sight (LOS) vector output of the target track integration algorithm 82. The other axes of the orthogonal three-axis coordinate system of the control function 30 may be referred to as the right-left axes (R-L) and the up-down axes (U-D). The projections of the relative velocity vector V on the R-L and U-D axes provide for components $\dot{X}_{LR}$ and $\dot{X}_{UD}$, respectively, of the relative velocity vector V. These two components $\dot{X}_{LR}$ and $\dot{X}_{UD}$ may be divided by the slant range R to obtain the components of the line-of-sight angle rate, denoted as $\alpha$. The LOS angle rate vector $\alpha$ may then be multiplied by a constant gain $K_\alpha$, i.e. the navigation ratio, to obtain the commanded turn rate of the missile velocity vector, denoted as $\alpha'$ in FIG. 10, which is a suitable command for the autopilots in the controls of some missiles. To generate a command suitable for the autopilots in the autopilots of other missiles, the vector cross-product between $\alpha'$ and the missile velocity vector, obtained preferably from the IMU 76, next is computed to effect the normal acceleration command vector $a_n$ which is provided to the autopilot 24 in the missile controls 20. Note that the normal acceleration command vector $a_n$ is comprised of two components—one along the up-down axis, denoted as $a_{UD}$ and the other along the R-L axis, denoted as $a_{LR}$.

Because of the division by slant range R to obtain the components of the line of sight angle rate in the command law algorithm 30, the effective gain of the missile control loop 110 approaches infinity as the range R approaches zero. This causes the control loop 110 to become marginally stable as the range approaches zero. However, this is mitigated in the present embodiment by making the commanded acceleration vector proportional to the normal velocity components, and thereafter the commanded acceleration vector is cascade-compensated before being provided to the missile controls 20. As a result, the control loop stability characteristics are well defined, even at very short ranges. Moreover, the desired stability characteristics may be realized despite variations in missile speed, air density, air frame parameters, . . . etc.

Figure 11:
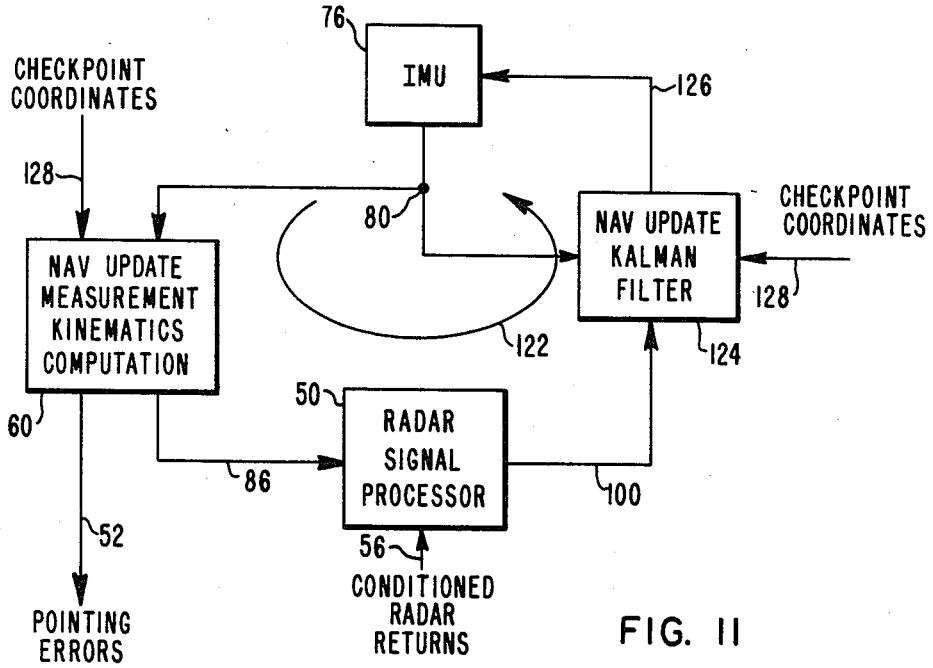
FIG. 11 is a block diagram schematic of a navigational update loop suitable for use in the embodiment of FIG. 1.

In air-to-ground scenarios, the radar signal processor 50 of the missile guidance subsystem may include a synthetic aperture radar processor governed by high-rate, e.g. 256 Hz, relative position and velocity vector estimates 120 (see FIG. 1) generated by the target track integration algorithm 82 to compensate for the motion of the missile in deriving a radar image of a ground target location. Referring to FIG. 11, in addition to the motion compensation provisions of the missile guidance subsystem, there may also be included a navigation update loop 122 which may include a navigation update Kalman filter 124. The purpose of the navigation update loop 122 is to correct IMU errors like the missile accelerometer platform misalignments, inertial sensor errors, biases in the gyros and accelerometers, gyro drift, and possibly scale factor errors, for example. These errors are basically imperfections in the inertial sensors and generally initial alignment errors.

The Kalman filter 124 may be configured or modeled using checkpoint coordinates 128 to estimate the IMU errors and generate a set of state variables 126 for the correction thereof. It is expected that under land target configurations, the navigation update loop 122 will alleviate transfer alignment requirements substantially. For example, precise monopulse pointing error measurements using checkpoint coordinates 128 will eliminate the necessities for prelaunch maneuvers to settle the troublesome vertical component of accelerometer platform misalignment in the IMU 76. The checkpoint coordinate measurements 128 will increase the observability of the IMU error states significantly. In operation, the navigation update loop 122 is closely analogous to the target track loop 104 described hereabove in which the IMU 76 corresponds to the target track integrators 82. The correspondence of the other components in the two loops 104 and 122 will become evident in comparing the FIGS. 1 and 11.

There are two types of navigation update measurements: check point measurements and range rate measurements along the antenna monopulse boresight. The check point measurement set may include slant range, line of sight range rate, monopulse pointing error (up/-down) and monopulse pointing error (left/right). The boresight range rate measurements may be performed by stepping the monopulse boresight through a scan pattern, with possibily three to six positions, at a stepping rate between 1 Hz to 1/10 Hz, for example. The radar returns 56, from which boresight range rate measurements may be made in the radar signal processor 50, come from points on the ground with unknown map coordinates. Therefore, boresight range rate measurements, unlike check point measurements, contain only velocity error information. Driving the navigation update Kalman filter 124 with a sequence of such measurements results in doppler-damping of the IMU 76. Based on error covariance analysis, simulation and test experience, a nine-state Kalman filter seems likely to meet the IMU accuracy requirements. Three of the states would include ownship position errors, another three would include ownship ground velocity errors, and the final three would include accelerometer platform misalignments, all are error estimates desired to correct the IMU 76. If necessary, the error estimate state vectors may be augmented with driving error state variables, e.g. antenna misalignments.

With regard to air-to-air scenarios of the missile guidance subsystem, the accelerations of air targets can be so large that inaccuracies in the target acceleration models used to generate Kalman gain vectors, in the Kalman filter 102, can be of some concern. (The Kalman gain vectors [K] are used to operate on the measurement differences $\Delta R$, $\dot{\Delta R}$, $\Delta\epsilon_A$ and $\Delta\epsilon_E$ for the purpose of extracting target track integrator error estimates $\Delta Xn$, $n=1$ to 9, refer to FIG. 7.) The most difficult air targets are manned aircraft, the accelerations of which not only can be very large, compared with those of surface targets, but also very erratic, compared with those of unmanned moving targets. Three steps can be taken to cope with target accelerations:

1. Have somewhat higher signal processor measurement data rates than those necessary for surface targets, albeit not nearly as high as those rates in the track loops of conventional air-to-air missiles.
2. If the targets are manner aircraft, use somewhat more realistic, but more complicated, models for targets accelerations in the Kalman filter 102 (e.g. Markov processes modelled by passing white noise through low-pass shaping filters, rather than random biases).
3. Make the Kalman filter 102 adaptive, as well as optimal, by using its inherent capability to monitor its own performance, and by heuristic adjustment of its target acceleration model if performance degradation is detected.

The fundamental principle underlying most schemes for making the Kalman filter 102 adaptive is: If its performance is near optimal, the sequences of measurement differences—in this application, $\Delta R$, $\dot{\Delta R}$, $\Delta\epsilon_A$, $\Delta\epsilon_E$—have the character of white noise. That is, the measurement differences at one time are statistically uncorrelated with the measurement differences at any other time. There are various tests for measurement difference correlation. The simplest of these entails passing the measurement differences through low-pass filters, and applying decision thresholds to these filter outputs. If a majority of the low-pass filter outputs is above the corresonding thresholds for a specified number of successive measurement events, an indication of excessive measurement sequence correlation, and of excessive Kalman filter performance degradation, is obtained. In this application, the most likely cause of Kalman filter performance degradation is a level of target acceleration which consistently exceeds the target acceleration variances in the Kalman filter's error model. If excessive Kalman filter performance degradation were indicated, that is, by the extraction of an index of filter performance as described supra, for example, the target acceleration variances in the Kalman filter error model may be adjusted accordingly. Even though this should return the Kalman filter performance to optimality, estimation accuracy may not be as good as it might be in the absence of the large target accelerations. The main objective is to minimize accuracy degradation, so as to prevent the large target accelerations from breaking the track loop lock on the target. That happens if the target escapes from any of the radar measurement "windows" controlled by the track loop: the set of range gates, the doppler filter bank or the radar antenna beam. This would not necessarily be catastrophic, but it at least would be highly disadvantageous. Track loop recovery requires a radar search capability, entailing additional mechanization complexity and loss of operating time.

Since large target accelerations usually are caused by sharp target maneuvers which cannot be sustained very long, and since Kalman filter accuracy would be degraded even if Kalman filter performance were restored to optimality by incrementing the target acceleration variances in the Kalman filter's error model, the target acceleration variances would be decremented after restoration of Kalman filter optimality. This would be done after a time delay long enough to account for uncertainty about the duration of a sharp target maneuver.

In a typical weapon deployment operation of a missile and associated missile guidance subsystem, it may be assumed that the missile starts out supported aboard a launch aircraft. It is desirable that the missile have its own inertial navigation system, that is not only the inertial measuring unit sensors of 76, but also a navigational computer as well as an autopilot as shown by the block 24 in FIG. 2. Prior to launch, the computer on board the launch aircraft may determine the initial conditions associated with launching the missile towards an identified target or an identified target location. These initial conditions may be entered into the missile guidance radar data processor 32 for initialization of the IMU 76 and the integration algorithm 82. Thereafter, the missile may be launched in a nominal flight path towards the target region.

Accordingly, the missile may be launched in either a blind or lock-on mode. For example, in the blind mode, the target has not been identified and the radar or seeker aboard the missile is searching for a target within a predetermined target region. Flight path may continue in this blind mode until the missile radar identifies the target and locks onto it. On the other hand, for the lock on mode, the launch aircraft has identified the target in the target region before launch and initializes the missile guidance subsystem to lock-on to the target prior to launch. It is preferable to launch in the blind mode because the missile may be launched much faster which protects the launch aircraft from exposure to enemy fire. That is, to lock on to a target before launch usually requires a lot of operator attention in which case the launch aircraft may have to remain in an hostile environment for a considerable time. Of course, having an active radar on board the launched missile permits launching the missile at any fly down range and letting the missile radar do its own search when it gets close enough to the target region. With the principles of the present invention embodied in a missile guidance subsystem this type of guidance scenario should be fairly accurate or at least provide for miss distances within the lethal requirements.

Generally after a launch, it may be desirable to delay the missile radar operations because of potential back scatter from the launch aircraft which may induce errors in the radar measurements. Because of such good initialization conditions being provided to the IMU 76 and track integration algorithm 82, the original estimates of the integration outputs i.e. relative position and velocity measurements, should be fairly accurate. Therefore, the launched missile may fly blind, if necessary after launch, until locking onto a target without any significant adverse affects. The Kalman filter algorithm 102 is also initialized, not with actual data as the IMU 76 and track integration algorithm 82, but with error statistic estimates derived from a priori information on error sources in the navigation system of the launch aircraft and in the target acquisition sensor, or sensors. Given uncertainty in this a priori information, the estimated variances with which the Kalman filter 102 is initialized may be made bigger than they are in the real world so that both the error statistics and the samples of the corresponding real errors may settle to their steady-state levels more quickly. It is desirable that a priori error statistics of the navigation system of the launch aircraft and of the target acquisition sensor, or sensors, be used in computing the error statistic estimates for initializing the Kalman filter 102.

Now, once the track loop 104 is locked on the target, so that measurements can be performed by the radar therein, the Kalman filter 102 may start generating track error estimates 106 for use in correcting the relative position and velocity vector estimate outputs 84 of the track integrators 82. The improved track integrator relative position and velocity vector estimates 84 are converted to radar measurement estimates 86 by the computational algorithm 60 for use in the radar signal processor 50 to center the range and range rate windows to be searched for the target return; measurement error statistics generated in the Kalman filter 102 may be used to define the sizes of these windows.

Likewise, the improved track integrator relative position and velocity vector estimates 84 are converted to estimated target direction measurements 52 by the computational algorithm 60 for use in the antenna beam steering controls 64/66 to center the search window or target direction, i.e. the antenna beam 54. If the antenna is a phased array, so that the beam width can be controlled dynamically, measurement error statistics generated in the Kalman filter 102 may be used to size this window. (In this context, "search" denotes the examination of an array of data cells, i.e. memory addresses, in the signal processor 50 for the purpose of finding the cell, or small cluster of cells, which contain signal returns from the target.) This precise control of the measurement windows in the signal processor 50 in turn minimizes the demands on the radar resources, and leads to greater attenuation of unwanted radar signals, such as ground clutter, thermal noise and multipath signals. The greater attenuation of unwanted radar signals causes the differences between computed and true kinematic quantities measured by the radar, $\Delta R$, $\dot{\Delta R}$, $\Delta\epsilon_A$ and $\Delta\epsilon_E$, to converge more rapidly. The steady-state levels toward which these measurements converge are nonzero because of residual unwanted radar signals and residual target track integrator errors.

In the track loop 104, the Kalman filter 102 continues to extract estimates of the tracking errors from the radar measurements 100 which may be used to correct errors in either the IMU 76 which is driving the track integration algorithm or in the track integration routine outputs 84, namely the relative position and velocity vector estimates. The Kalman filter 102 also extracts estimates of the target acceleration vector or $\Delta X7$, $\Delta X8$, and $\Delta X9$ from the radar measurements 100 which may be used to drive the track integration routine 82, along with the outputs 80 of the IMU 76. In time, the Kalman filter 102 adjusts the track loop error statistics downward, i.e. computed error statistics, to reflect those corrections in the IMU 76 and track integration routine 82 which permit the track loop gain to settle, along with the track loop error estimates, in an optimal manner.

The point to be made here is that as soon as the radar starts providing measurement differences 100 to the Kalman filter 102, the accuracy of the track loop 104 improves in accordance with the error estimates 106 performed by the Kalman filter 102. It is understood that if the designated target is a stationary ground target or navigation checkpoint, the radar signal processor 50 may generate a synthetic aperture radar map for utilizing ground clutter to locate the target or checkpoint. In this case, the target or checkpoint is located by cross-correlating the target background, i.e. clutter pattern, observed by the radar with a stored image of the target background obtained a priori by reconnaissance sensors.

In the map mode, the synthetic aperture radar may utilize the map coordinates of a navigation checkpoint to estimate IMU errors for the purpose of updating the IMU as described in connection with the embodiment of FIG. 11. Furthermore, relative velocity estimates 120 generated from the relative position and velocity outputs of the target track integration routine 82, at a sufficiently high rate (e.g. 256 Hz), may provide the necessary missile motion compensation for the synthetic aperture radar to provide resolution enhancement of the formed radar image of the target or navigation checkpoint.

In connection with the synthetic aperture radar processing, it may be appropriate to have the missile guided on a flight path which deviates from that generated by the standard proportional navigation control law in order to provide an adequate squint angle between the line-of-sight and the missile velocity vector. An adequately large squint angle is necessary for good synthetic aperture radar cross-range resolution. The shape of the preferred curved flight path has been found in missile guidance simulations not to degrade the missile guidance accuracy significantly. For air targets, the radar signal processor 50 may include a moving target indicator (MTI). In addition, the Kalman filter algorithm 102 may estimate target accelerations to drive the target track integration routine 82, along with the missile acceleration estimates generated by the IMU 76.

Because of the dynamic exactness of the track loop 104, the control law algorithm 30 may compute the maneuver commands 22 with very good estimates of the relative position and velocity of the missile with respect to the target. The control law algorithm 30 may use proportional navigation techniques as described in connection with FIGS. 9 and 10 hereabove to drive the missile controls 20 which includes an autopilot 24. The autopilot 24 in turn may provide torque commands 28 to the control surface actuators 26 of the missile to guide the missile on an accurate flight path to the target. The IMU 76 may continuously measure the true acceleration of the missile in flight and provide missile acceleration signals 80 representative thereof to the track integration algorithm 82. The algorithm 82 derives intermediate values of the relative position and velocity of the missile and compensates these intermediate values by the error correction signals derived through the Kalman filter algorithm 102 to continuously improve the relative position and velocity outputs thereof. The missile is thus guided on an accurate path until collision, or warhead detonation by a proximity fuse.

In summary, the potential accuracy of the missile guidance appears excellent, so that there will be a strong reason to put a high performance radar, such as a synthetic aperture radar, for example, on a tactical missile. The control loop of a high performance missile may be required to operate at a rate as high as 100 Hz, for example; yet a synthetic aperture radar is generally capable of outputting data in the vicinity of 1 Hz. The present invention makes the synthetic aperture radar compatible with the control loop by mixing the high data rate from the inertial measuring unit 76, 256 Hz, for example, with the low data rate from the synthetic aperture radar in the tracking loop 104.

In addition, the synthetic aperture radar is generally not capable of measuring the quantities at a rate to generate the maneuver commands 22 for the missile autopilot 24. As a result, it is necessary to estimate the required quantities from those which the radar does measure and this is additionally accomplished in the track loop 104. The Kalmanization of the track loop 104 permits accommodation of synthetic aperture radar mode changes more easily. In addition, the flow of accurate target track data into the control loop 110 is not stopped by short-term interruptions of radar measurements caused by unfavorable flight path geometry at very short ranges or by intermittent jamming. Accordingly, the track loop 104 provides accurate relative position and velocity data to steer and stabilize the radar beam, to motion compensate the synthetic aperture radar imagery for the line of sight component of relative velocity, and to control the range gates and doppler filter banks of the radar signal processor 50.

Moreover, the Kalmanized track loop 104 of the instant missile guidance subsystem does not let large amounts of angle glint noise into the control loop prior to missile impact. Because of the Kalmanization, the error observability is very good; and therefore, an effective bandwidth decrease as glint noise increases is provided without incurring a dynamic lag error penalty. Essentially, the inertial sensor errors have been swapped for dynamic lag errors. It is expected that miss distance sensitivity to inertial sensor errors is very low. Furthermore, the control loop in the instant missile guidance subsystem is not permitted to become marginally stable at very short ranges, that is, the proportional navigation control law used in the algorithm 30 of the present embodiment is designed to prevent this from occurring.

It is understood that the instant missile guidance subsystem as described in connection with the embodiments of FIGS. 1 and 2 is not only compatible with synthetic aperture radar processing, but also with other kinds of airborne tracking radars. Changes in the radar may require modifications of the control law algorithm 30 and the Kalman filter algorithm 102 which will not deviate from the broad principles of the present invention.

I claim:

1. A missile guidance subsystem disposed onboard a missile and operative during the flight of said missile to cooperate in guiding said missile to the location of a target, said missile guidance subsystem comprising:

a radar including an antenna system, a front end, and a signal processor, said antenna system governed by beam steering commands to maintain the beam pattern of said radar antenna on said target location, said front end for receiving radar echo signals within said beam pattern and conditioning said radar echo signals for processing by said signal processor, said signal processor for deriving true radar measurements of said missile kinematics in relation to said target kinematics from said conditioned radar echo signals;

control means governed by a set of maneuver commands to control said missile kinematics;

an inertial measuring unit for generating signals corresponding to the acceleration of said guided missile in accordance with predetermined spatial coordinates;

means for integrating said acceleration signals of said inertial measuring unit to generate estimates of the relative kinematics of said missile and target in accordance with said spatial coordinates;

means for converting said estimates of the relative kinematics into a priori estimates of radar measurements of said missile and target relative kinematics, and into beam steering commands for said radar antenna system, said signal processor operative to compute signals representative of the differences between corresponding estimated and true radar measurements;

filtering means for deriving error signals based on an estimating function of said computed radar measurement difference signals, said integrating means operative to generate intermediate relative kinematics estimates according to said spatial coordinates in the integration process thereof, said error signals derived in accordance with said spatial coordinates for correcting corresponding intermediate relative kinematics estimates of said integrating means to render said relative kinemaic estimates; and means for generating said set of maneuver commands based on a control law function of said relative kinematics estimates.

2. A missile guidance subsystem in accordance with claim 1 wherein the integrating means, converting means, radar and filtering means constitute, in combination, a radar tracking loop governed by the acceleration signals generated by the inertial measuring unit; and wherein said filtering means includes a Kalman filter portion for generating estimates of tracking loop errors based on optimal filter techniques using a priori information of error processes of said tracking loop.

3. A missile guidance subsystem in accordance with claim 2 wherein the Kalman filter portion includes: a set of Kalman gain vectors for operating on the radar measurement difference signals for generating the tracking loop error estimates; and means for extracting from the radar measurement difference signals an index of filter performance for use in adjusting said Kalman gain vectors used in said error estimation process to compensate for errors in modeling target accelerations.

4. A missile guidance subsystem in accordance with claim 1 wherein the integrating means, converting means, radar and filtering means constitute, in combination, a radar tracking loop governed by the acceleration signals generated by the inertial measuring unit at a first rate; wherein the radar signal processor is operative at a second rate, substantially slower than said first rate, to measure the differences between true and estimated radar measurements; wherein the filtering means is operative to derive the error signals at a rate commensurate with said second rate; and wherein the integrating means includes means for accommodating the acceleration signals at said first rate and the error signals at said slower rate to generate the relative kinematics estimates at a rate commensurate with said first rate.

5. A missile guidance subsystem in accordance with claim 1 including a navigational update filtering means for deriving error signals based on an estimating function of the radar-measured kinematics difference signals to compensate for errors in the acceleration signals generated by the inertial measuring unit.

6. A missile guidance subsystem in accordance with claim 1 wherein the inertial measuring unit includes means for generating the acceleration signals corresponding to the acceleration of the missile along each coordinate of a predetermined orthogonal 3-axis coordinate system; wherein the integrating means includes an integration function to generate intermediate relative velocity and position estimates from said acceleration signals corresponding to each axis of said orthogonal coordinate system; wherein the filtering means derives an error signal for each intermediate relative position and velocity estimate from the differences between corresponding estimated and true radar measurements; and wherein the integrating means includes a correction function to correct each intermediate relative position and velocity estimate with its corresponding error signal to render a relative position and velocity estimate for each axis of said orthogonal coordinate system.

7. A missile guidance subsystem in accordance with claim 6 wherein the converting means includes means for converting the relative position and velocity estimates into estimated radar measurements including range, range rate, and antenna beam pointing angle errors in azimuth and elevation; wherein the signal processor includes means for deriving true radar measurements including true range, true range rate, and true antenna beam pointing angle errors in azimuth and elevation from the conditioned radar echo signals and said corresponding estimated radar measurements, said signal processor further including means for measuring the differences between said corresponding estimated and true radar measurements and for generating signals representative thereof; and wherein the filtering means includes means for deriving the position and velocity error signals for each axis of the orthogonal coordinate system based on an estimating function of said measurement difference signals in range, range rate, antenna azimuth beam pointing angle error and antenna elevation beam pointing angle error.

8. A missile guidance subsystem in accordance with claim 7 wherein the integrating means, converting means, radar and filtering means constitute, in combination, a radar tracking loop governed by the acceleration signals generated by the inertial measuring unit; and wherein the filtering means includes a Kalman filter portion for generating estimates of position and velocity tracking loop errors for the 3-axis orthogonal coordinate system based on optimal filter techniques using a priori information of error processes of said tracking loop.

9. A missile guidance subsystem in accordance with claim 8 wherein the Kalman filter portion includes: a set of Kalman gain vectors for operating on the radar measurement difference signals in range, range rate, and antenna beam pointing angle errors in azimuth and elevation for generating estimates of position, velocity and acceleration tracking loop errors; and means for extracting from said radar measurement difference signals an index of filter performance for use in adjusting said Kalman gain vectors used in said error estimation process to compensate for errors in modeling target acceleration.

10. A missile guidance subsystem in accordance with claim 6 wherein the generating means includes means for generating a set or maneuver commands according to an up-down and left-right coordinate axis system referenced to the velocity vector of the missile, said generation based on a control law function of the relative position and velocity estimates of the predetermined 3-axis orthogonal system generated by the integrating means.

11. A missile guidance subsystem in accordance with claim 10 wherein the control law function of said generating means includes a proportional navigation control law function.

12. A missile guidance subsystem in accordance with claim 6 wherein the integrating means, the generating means, the control means and the inertial measuring unit, in combination, constitute a control loop of the guidance subsystem.

13. A missile guidance subsystem in accordance with claim 6 including a navigational update loop comprising a navigation update filtering means governed by signals including the radar measurement difference signals and predetermined check point coordinates to derive error correction signals for the inertial measuring unit.

14. A missile guidance subsystem in accordance with claim 6 wherein the radar signal processor includes a synthetic aperture radar processor governed by the relative position and velocity estimates to compensate for the motion of the missile in deriving a radar image of a ground target location.

15. A missile guidance subsystem in accordance with claim 6 wherein the converting means includes means for converting the relative position estimates of the predetermined orthogonal 3-axis coordinate system into beam steering commands including estimated antenna beam pointing angle errors along the azimuth and elevation axis coordinates of the radar antenna;

and wherein the radar antenna includes means governed by said estimated antenna azimuth and elevation beam pointing angle errors to steer the antenna beam generated thereby.

16. A missile guidance subsystem in accordance with claim 15 wherein the converting means includes means for converting the relative position estimates of the predetermined orthogonal 3-axis coordinate system into beam steering commands including estimated antenna beam pointing angle errors along azimuth and elevation axis in accordance with unit direction vectors coordinatized in antenna system reference axes for positioning an antenna beam electronically.

* * * * *